US006994206B2

(12) United States Patent
Adamski et al.

(10) Patent No.: US 6,994,206 B2
(45) Date of Patent: Feb. 7, 2006

(54) APPARATUS FOR FEEDING ROLLS OF CUT PRODUCTS TO A WRAPPER

(75) Inventors: Brian C. Adamski, Pulaski, WI (US); Matthew A. Schmitz, Allouez, WI (US); Lawrence D. Mikulsky, Green Bay, WI (US)

(73) Assignee: Paper Converting Machine Company, Green Bay, WI (US)

( * ) Notice: Subject to any disclaimer, the term of this patent is extended or adjusted under 35 U.S.C. 154(b) by 0 days.

(21) Appl. No.: 10/772,657

(22) Filed: Feb. 5, 2004

(65) Prior Publication Data

US 2005/0173227 A1 Aug. 11, 2005

(51) Int. Cl.
*B65G 19/08* (2006.01)

(52) U.S. Cl. ..... 198/733; 198/570

(58) Field of Classification Search ..... 198/570, 198/733, 419.2; 83/107, 155, 404.2, 409.1
See application file for complete search history.

(56) References Cited

U.S. PATENT DOCUMENTS

| | | | | |
|---|---|---|---|---|
| 3,193,136 | A * | 7/1965 | Stumpf et al. | 221/40 |
| 4,018,031 | A | 4/1977 | Smaw | 53/159 |
| 4,159,760 | A | 7/1979 | Kovacs et al. | |
| RE30,598 | E | 5/1981 | Spencer | |
| 4,398,383 | A * | 8/1983 | Prakken | 53/537 |
| 4,430,844 | A | 2/1984 | James | |
| 4,716,714 | A * | 1/1988 | Tisma | 53/575 |
| 4,977,803 | A * | 12/1990 | Blom | 83/23 |
| 5,127,209 | A * | 7/1992 | Hunter | 53/439 |
| 5,339,606 | A * | 8/1994 | Benz | 53/444 |
| 5,458,033 | A * | 10/1995 | Wierschke | 83/104 |
| 5,475,917 | A * | 12/1995 | Biagiotti | 198/428 |
| 5,924,346 | A | 7/1999 | Wunderlich | |
| 6,123,002 | A | 9/2000 | Wunderlich | |
| 6,332,527 | B1 | 12/2001 | Wierschke | |
| 6,532,851 | B2 * | 3/2003 | Moss et al. | 83/459 |
| 6,619,017 | B2 | 9/2003 | Franzaroli | 53/435 |

FOREIGN PATENT DOCUMENTS

| | | |
|---|---|---|
| EP | 0 967 163 A2 | 12/1999 |
| EP | 0 967 163 A3 | 12/1999 |
| WO | WO 00/56605 | 9/2000 |

* cited by examiner

*Primary Examiner*—Douglas Hess

(57) ABSTRACT

An apparatus for advancing cut products from a saw to a wrapper includes a plurality of product supports for supporting multiple rows of cut products. A first or buffer portion of the apparatus includes an entry portion of the product supports and includes a first conveyor and a pair of flight bars mounted on the first conveyor. A second or pusher portion of the apparatus includes an exit portion of the product supports and includes a second conveyor for each of the product supports and a pair of pushers mounted on each of the second conveyors. A first drive motor advances the first conveyor and the flight bars thereon for pushing cut products on the product supports from the entry portion toward the second conveyors. A second drive motor is drivingly connected to at least one of the second conveyors, and a third drive motor is drivingly connected to at least another of the second conveyors whereby the pushers mounted thereon can be driven independently of each other for pushing cut products toward the exit portions of the product supports. Upper and lower speed-up belts may be mounted adjacent the exit portions of the product supports for advancing and separating the cut products.

15 Claims, 12 Drawing Sheets

APPARATUS FOR FEEDING ROLLS OF CUT PRODUCTS TO A WRAPPER

BACKGROUND

This invention relates to an apparatus for feeding cut products, such as rolled tissue product, from a log saw to a wrapper. The rolled tissue product can include bathroom tissue and paper towels.

In all present art, cut product from the log saw is randomly conveyed and accumulated on a belted or plastic chain conveyor that is typically 65 to 100 feet in length. The cut product is conveyed to the wrapper, where a set of metering belts (choke belts) coordinates and times the placement of the product as it enters the wrapper. A typical metering belt system is disclosed in U.S. Pat. No. 4,159,760.

To insure that the product is properly conveyed into the metering belts, the surface speed of the conveyor must run at a rate faster than the average speed of the metering belts. If the number of infeed lanes feeding the wrapper exceeds the width of the package format being produced, the metering belts must "converge" the product into the wrapper. During converging, product on the conveyor must accelerate and decelerate to intermittently feed the proper number of infeed lanes. The surface properties of the conveyor must generate sufficient frictional forces to accelerate product into the metering belts without leaving gaps between successive rolls. The acceleration rate is high when converging from four or more infeed conveyor lanes down to one, two, or three lanes into the wrapper.

The problem with the present art is that cut roll product exiting the saw becomes randomized before entering the wrapper. The wrapper must reestablish an organized and timed flow of product to complete the wrapping process. Conventional conveying systems require friction between the product and conveyor to properly transport the product to the next operation. Excessive friction levels damage the outer surface of the product or package, while insufficient friction levels result in gaps and improper product placement at the next operation. The friction levels are difficult to regulate because they vary with the amount of product residing on the conveyor and the surface speed of the conveyor. The infeed conveyors are usually very long, typically 65 to 100 feet in length, and require a significant amount of floor space. The conveyor length is determined by the desired friction levels and also by the amount of product accumulation needed in case of a process interruption. Product accumulation is needed because the operating speeds of the log saw, wrapper, and bundler are typically not coordinated with one another.

Another problem with the present art is that the metering belts are known to cause product damage. Metering belts are typically used to compress, hold, and regulate the position of the product as it enters the wrapper. The compression forces must be sufficient to withstand the frictional forces generated by the infeed conveyor so that the product does not slip in the belts. The force is very difficult to regulate as product firmness and/or product diameter varies.

To solve this problem, a method is needed that eliminates the randomness and accumulation of product between the log saw and wrapper. The cutting and wrapping processes must be combined and coordinated with one another, rather than having each process operate independently. The method used to transport and time the product between the log saw and wrapper should not require conveyor belts or metering belts, as both are known to cause product damage.

SUMMARY OF THE INVENTION

The invention uses flighted conveyors to establish an organized and timed flow of product between the log saw and the wrapper. This eliminates the belted infeed conveyors and metering belts commonly used on conventional systems. A conventional log saw is mated to first and second flighted conveyors which feed cut product to a conventional wrapper infeed.

The first flighted conveyor, called a buffer, acts as a storage location for cut rolls as they exit the log saw and intermittently transports cut rolls to the second flighted conveyor, called a pusher. A set of flights in the pusher selectively conveys one or more lanes of product to the wrapper. The number of lanes that the pusher conveys to the wrapper depends on the desired package format being produced at the wrapper.

The invention eliminates the belted infeed conveyors typically used to transport product between the log saw and wrapper. These systems are known to cause product damage, as the belted surface speed is always greater than the speed at which the wrapper takes away product. The slipping action causes product damage to the outer layers of the rolls. These conveying systems are typically 65 to 100 feet in length, compared to 30 to 35 feet for the disclosed invention. This results in reduced floor space requirements, installation costs, and maintenance costs.

The invention also eliminates the metering belts (choke belts) used on conventional wrapping systems, which are both known to cause product damage. In addition to product damage, the metering belts are known to reduce machine efficiency if product slips through the belts or a gap is created between successive rolls. Both situations result in product being out of time with the wrapper infeed conveyor, causing a jam. Slippage and "gapping" typically occur when the product diameter firmness varies slightly. The invention is not affected by product firmness or product diameter variations. The converting line will therefore operate more efficiently.

The invention also eliminates the need to start and stop the forward motion of the product on the infeed conveyor during "converging". Conventional systems use the metering belt systems to intermittently start and stop the feeding of product if the desired format being produced does not coincide with the number of lanes being cut by the saw. The cycling frequency is dependent on the production rate and the package format being produced. Between each cycle, product residing on the infeed conveyor is accelerated and decelerated. Friction generated between the infeed conveyor belt and product must be sufficient to maintain a continuous slug of product without creating any gaps between products. If the product cannot be accelerated fast enough, the production rate of the wrapper must be reduced. The invention overcomes this problem by feeding entire logs or "slugs" of cut rolls into the wrapper at a uniform rate.

DESCRIPTION OF THE DRAWING

The invention will be explained in conjunction with a illustrative embodiment shown in the accompanying drawing, in which.

DESCRIPTION OF SPECIFIC EMBODIMENT

Figure 1:
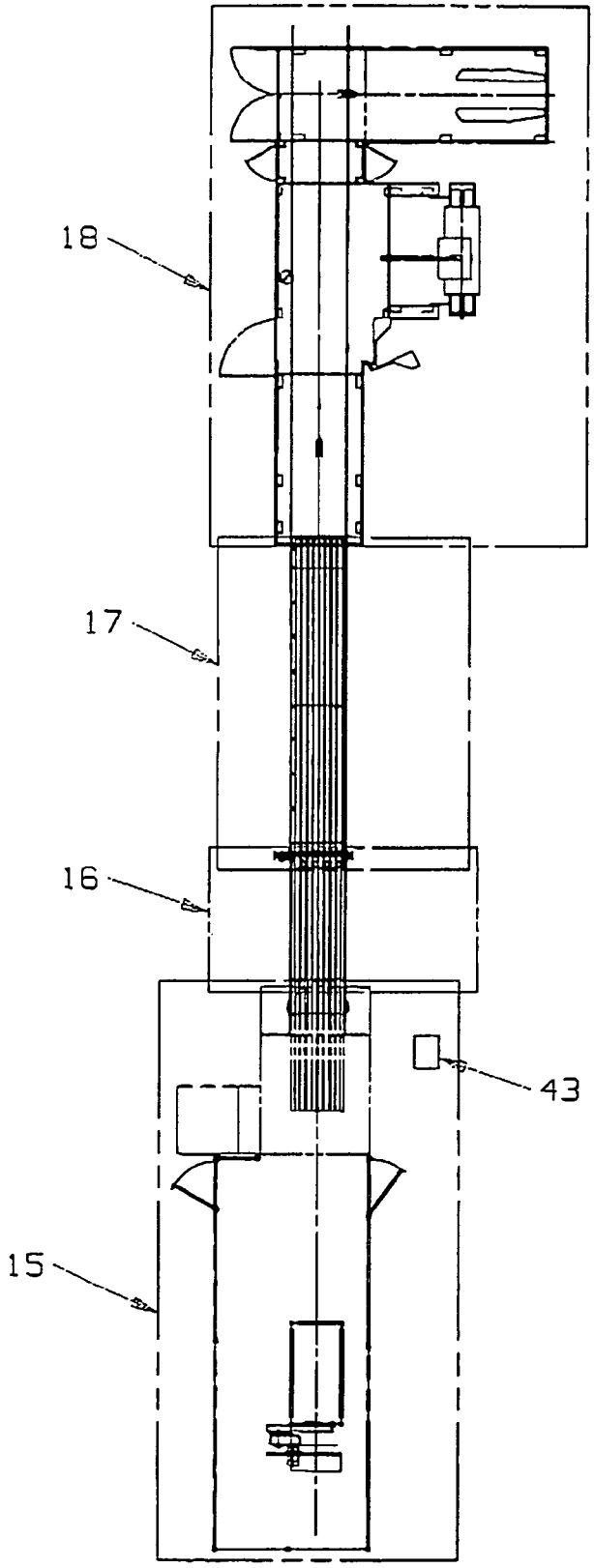
FIG. 1 is a plan view of a conventional log saw and a conventional wrapper which are joined by a pair of flighted conveyors in accordance with the invention.
Figure 2:
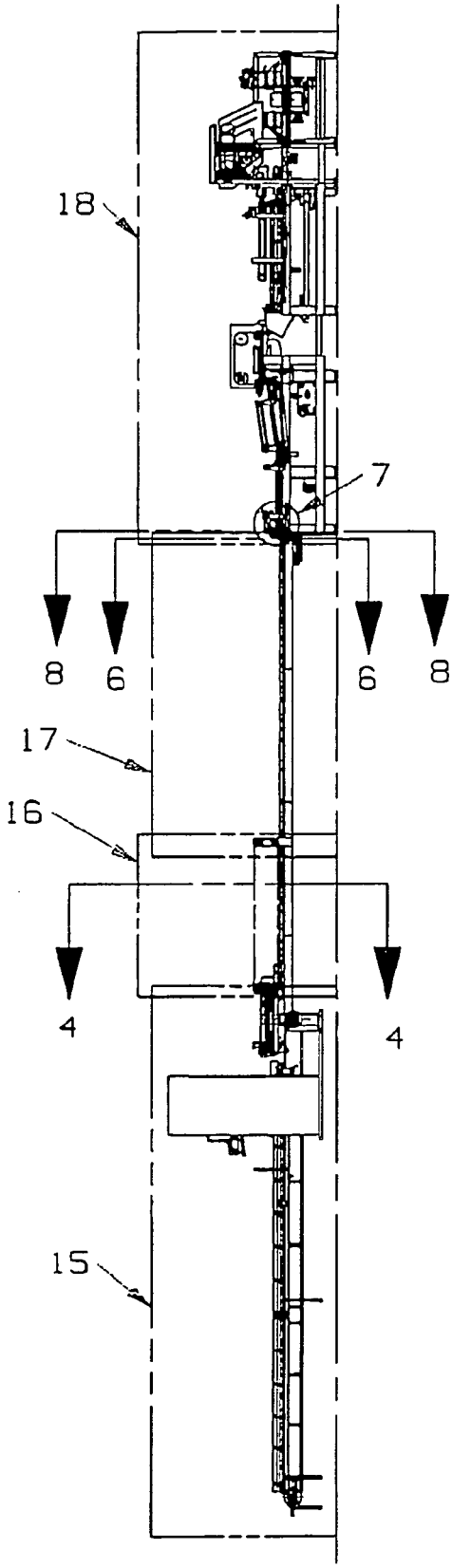
FIG. 2 is a side elevational view of the apparatus of FIG. 1.

The invention combines the process of cutting and wrapping products, such as rolled tissue product, by establishing an organized and timed flow of product as it exits a log saw until it is fed into the wrapper. Referring to FIGS. 1 and 2, a conventional log saw 15 is mated to a first flighted conveyor 16 and a second flighted conveyor 17 before a conventional wrapper 18.

U.S. Pat. Nos. Re. 30,598, 5,924,346, and 6,123,002 describe log saws for cutting logs of convolutely wound paper tissue or toweling into consumer-sized rolls. Such log saws typically cut though multiple rows or lanes of logs.

The first flighted conveyor 16 functions as a buffer and provides a storage location for cut rolls as they exit the log saw 15. The buffer intermittently transports the cut rolls to the second flighted conveyor 17. The second conveyor selectively conveys one or more lanes of product to the wrapper 18.

U.S. Pat. No. 4,430,844 describes a conventional wrapper for wrapping rolls such as bathroom tissue and paper towels. U.S. Pat. No. 4,159,760 describes a typical metering belt system for coordinating and feeding the rolls to the wrapper.

Figure 3:
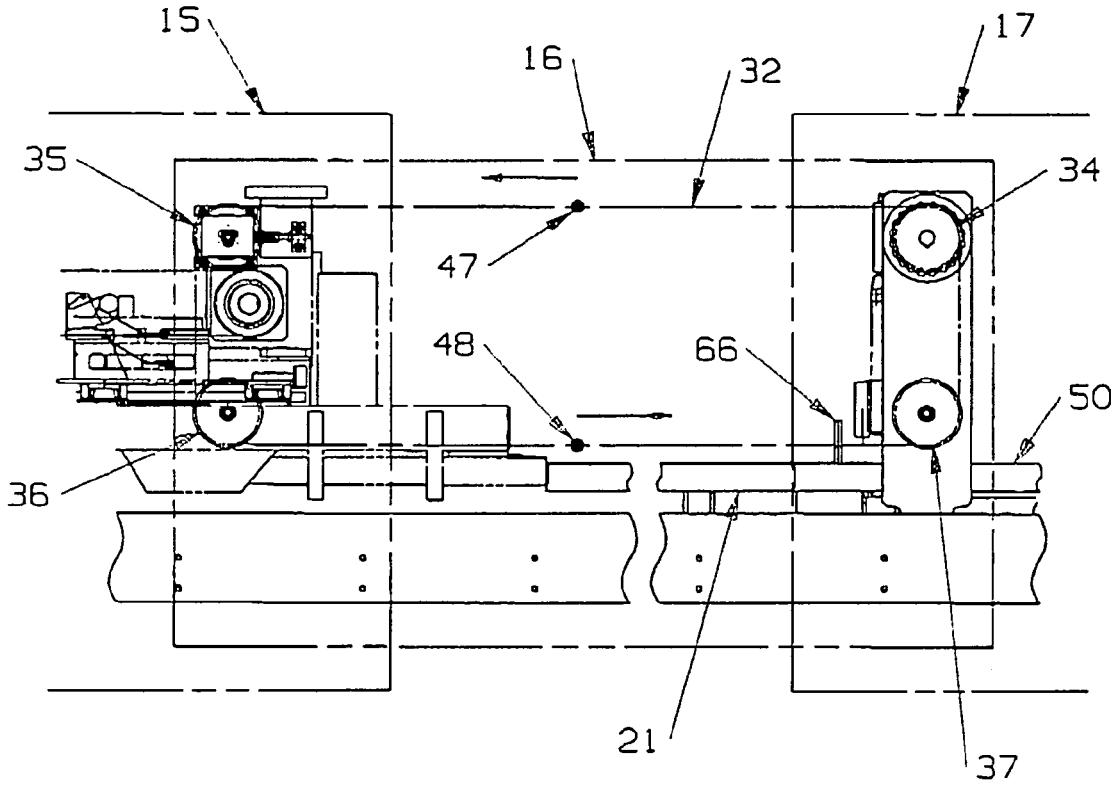
FIG. 3 is a side elevational view of the first flighted conveyor.
Figure 4:
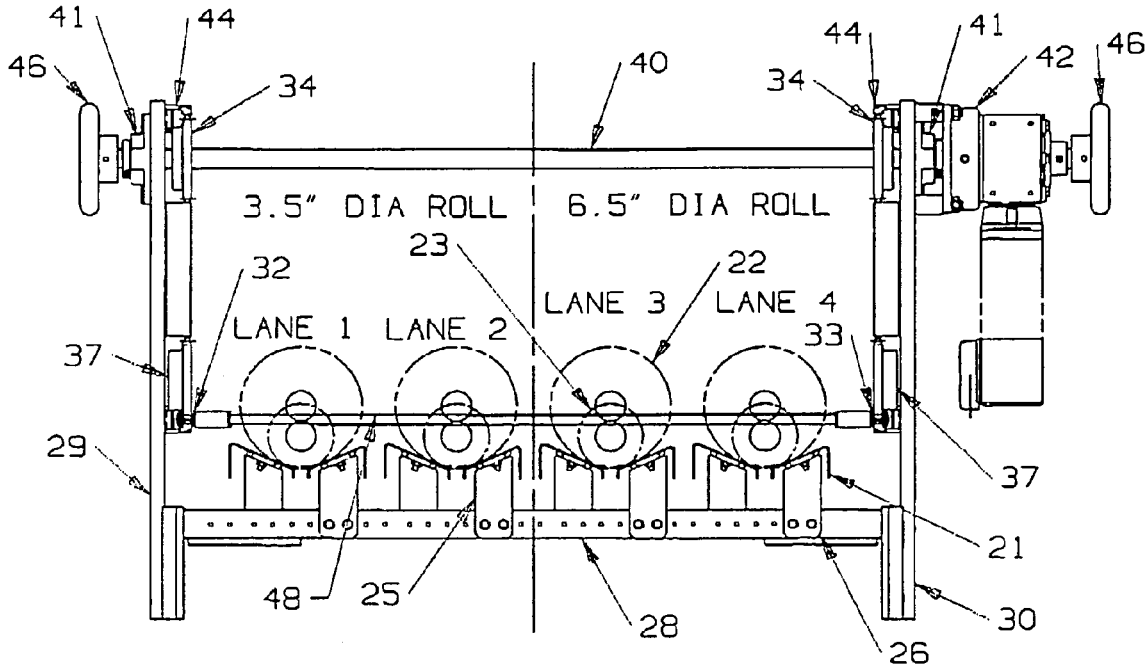
FIG. 4 is a fragmentary sectional view taken along the line 4—4 of FIG. 2.

Referring to FIGS. 3 and 4, the first conveyor 16 includes a series of sheet metal guide trays or product supports 21 which are aligned with the lanes of the log saw for supporting the cut products as they exit the log saw. As can be seen in FIG. 4, the guide trays are trough-shaped or generally V-shaped and can accommodate a wide range of product diameters. FIG. 4 illustrates large diameter rolls 22 and small diameter rolls 23 in dotted outline. A typical range of diameters is 3.5 to 6.5 inches. In the embodiment illustrated, the first conveyor 16 includes four guide trays 21 which support four rows or lanes of cut logs, designated Lane 1 through Lane 4.

Each trough 21 is supported by right and left mounting brackets 25 and 26 which are spaced along the length of the trough. The mounting brackets are attached to cross braces 28 which are supported by right and left side frames 29 and 30.

A pair of endless chains 32 and 33 are each supported by a drive sprocket 34 and idler sprockets 35, 36, and 37 which are rotatably mounted on the side frames. The two drive sprockets 34 are keyed to a cross shaft 40 (FIG. 4). The cross shaft is mounted in a pair of frictionless flange bearings 41 and is rotatably driven by a variable frequency AC motor or servo motor and gearbox 42 which are mounted on the left side frame 30. The motor is controlled by a conventional programmable controller 43 (FIG. 1), which may also control the log saw 15 and the wrapper 18. Chain guides 44 on the side frames assist in supporting the endless chains.

Referring to FIG. 3, idler sprocket 35 is spring-loaded and is allowed to translate in a set of gibs to maintain chain tension. Handwheels 46 (FIG. 4) are mounted on the ends of the cross shaft 40 to allow manual adjustment of the drive system for maintenance purposes.

A pair of flight bars 47 and 48 extend between and are attached to the two endless chains 32 and 33. The flight bars are spaced apart by one-half the length of the endless chains.

After the log saw has cut one or more logs into full sets of rolls and delivered them to the guide trays 21, the motor 42 actuates the endless chains 32 and 33 to move one of the fight bars 47, 48 from above the cut rolls into engagement with the last roll in each lane. As the flight bar continues to move to the right in FIG. 3, the cut rolls are pushed along the guide trays into the second flighted conveyor 17.

Figure 5:
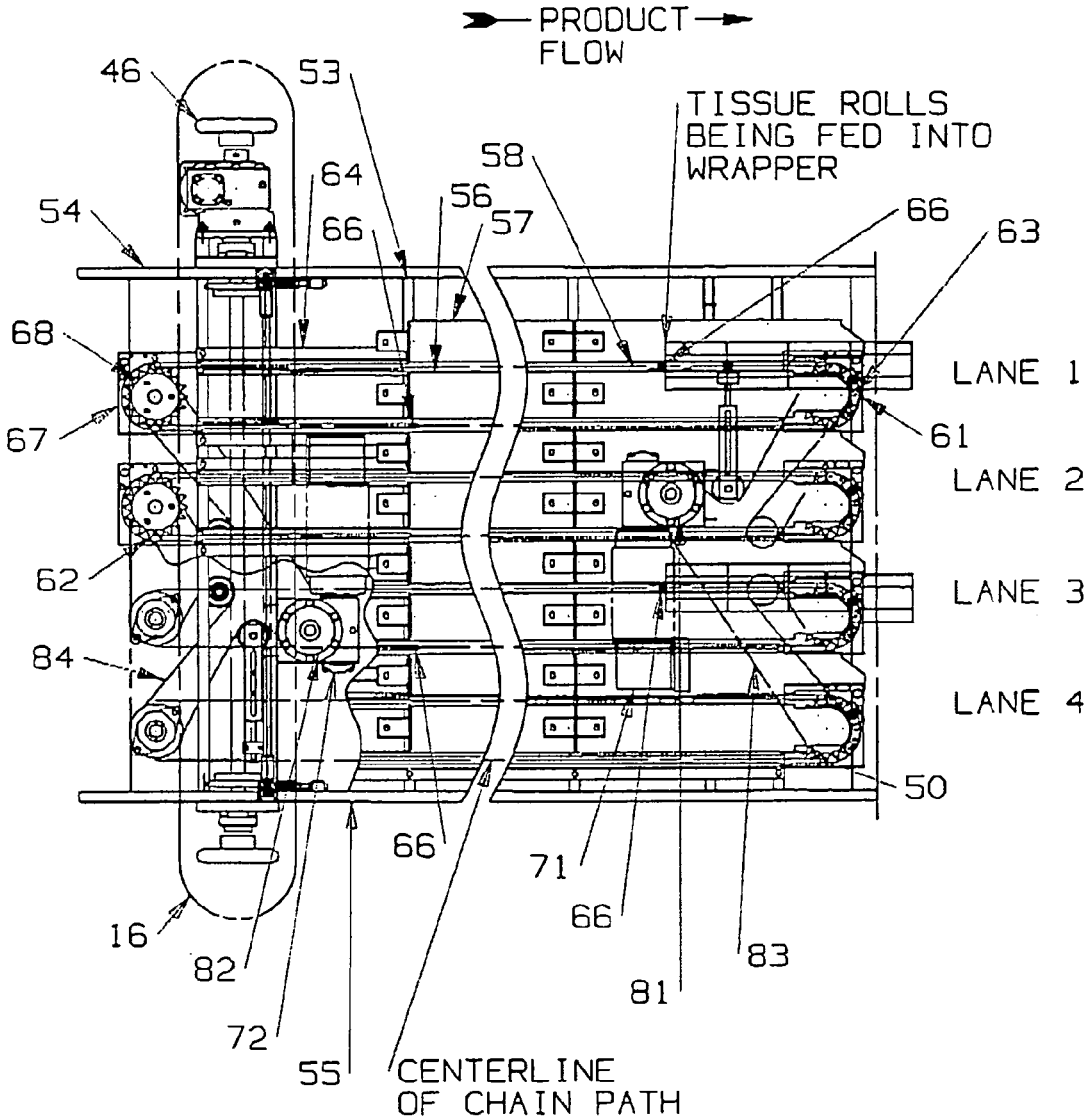
FIG. 5 is a fragmentary top plan view of the second flighted conveyor.
Figure 6:
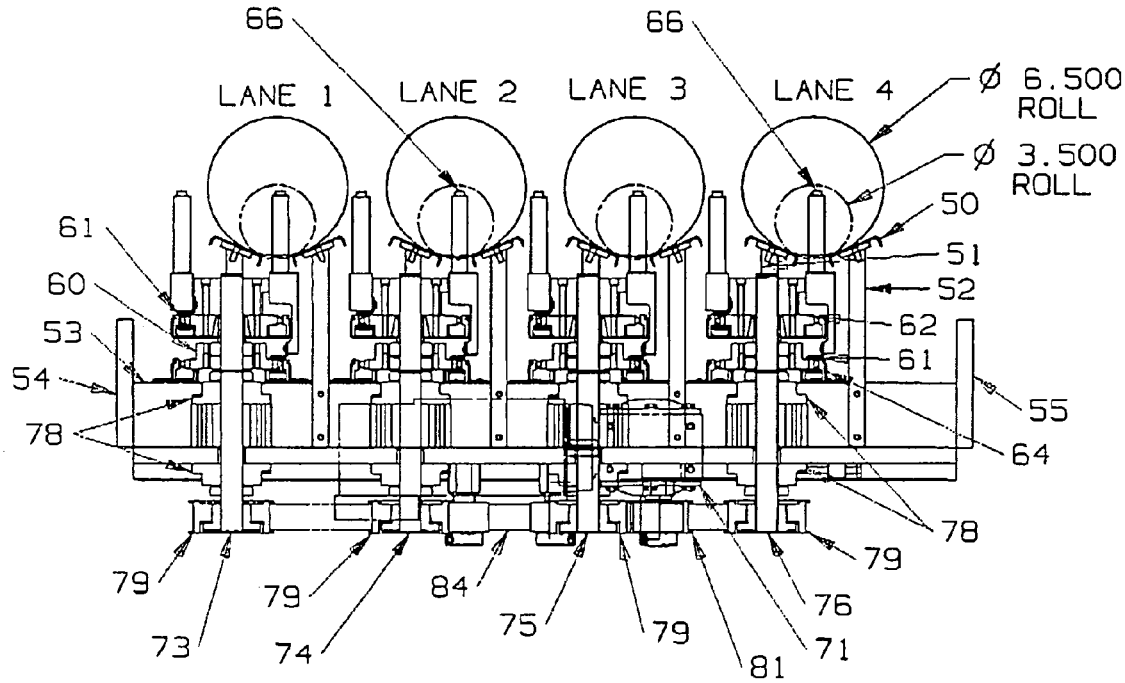
FIG. 6 is a sectional view take along the line 6—6 of FIG. 2.

Referring to FIGS. 3, 5, and 6, the second flighted conveyor 17 includes sheet metal guide trays or product supports 50 which are aligned with the guide trays 21 of the first conveyor 16. In the preferred embodiment illustrated in the drawings, the guide trays 50 are integral continuations of the guide trays 21 and provide support for four lanes of product. If desired, however, the guide trays 50 may be formed separately from the guide trays 21.

The guide tray 50 are also trough-shaped or generally V-shaped and are supported by a series of right and left mounting brackets 51 and 52 which are spaced along the length of the trough. The mounting brackets are attached to cross braces 53 which are supported by right and left side frames 54 and 55. The side frames 54 and 55 may be integrally formed with side frames 29 and 30 of the first conveyor section or can be separately formed.

Each of the guide trays 50 is formed from right and left side plates 56 and 57 which are supported, respectively, by the right and left mounting brackets 51 and 52. The side plates are separated at the middle of the trough to provide a longitudinally extending center slot 58 in each guide tray.

A pair of endless chains 61 are mounted beneath each of the guide trays 50. Each chain is driven on one end by a driven sprocket 62 and is tensioned on the opposite end by a take-up sprocket 63. The chains are guided along their length by chain guides 64.

One or more pusher flights 66 are mounted on each chain 61 depending upon the package format which is being produced by the wrapper 18. Each pusher 66 slips into a receptacle pin to facilitate easy mounting and removal. The pushers are supported around the circumference of the sprockets 62 by support guides 67 and bumper guides 68. In the embodiment illustrated, two pushers 66 are mounted on each chain 61.

Approximately one-half of each chain 61 extends directly below a slot 58 in one of the guide trays 50, and the pusher 66 on that portion of the chain extends upwardly through the slot so that it can engage and push a set of rolls along the guide trays.

At least two independent drive systems are used to actuate the flight pushers 66. The drive systems illustrated in the drawing comprise servo motors and gearboxes 71 and 72 which are each drivingly connected to four vertical driven shafts 73, 74, 75, and 76. The servo motors are controlled by the controller 43. Each of the driven shafts is mounted in a pair of frictionless flange bearings 78. At the left end of the conveyor one of the driven sprockets 62 for the upper chains 61 is keyed to the upper end of each drive shaft while an idling sprocket 60 for the lower chain is mounted in a pair of bearings. A timing belt pulley 79 is keyed to the lower end. At the right end of the conveyor, one of the driven sprockets 62 for the lower chains 61 is keyed to the middle of the drive shaft while an idling sprocket 60 for the upper chain is mounted in a pair of bearings. A timing belt pulley 79 is keyed to the lower end.

A timing belt pulley 81 is driven by the motor and gearbox 71, and a timing belt pulley 82 is driven by the motor and gearbox 72 (FIG. 5). A timing belt 83 is driven by the pulley 81 and drives the driven shafts 73, 74, 75, 76 for the upper chain 61. A timing belt 84 is driven by the pulley 82 and drives the driven shafts 73, 74, 75, 76 for the lower chain 61.

The two independent drive systems allow a set of rolls in lanes 1, 2, 3, and 4 to be fed to the wrapper 18 independently of a second set of rolls in lanes 1, 2, 3, and 4. By selectively adding or removing pusher flights 66 to the endless chains 61, the operator can phase the placement of the rolls in each lane relative to another lane. If desired, a separate drive system could be provided for each lane so that all of the lanes could be operated independently.

The second flighted conveyor 17 conveys one or more lanes of product to the wrapper infeed 18. The wrapper infeed takes a continuous grouping of cut rolls, abutted end to end, and creates a gap between each roll. The rolls are subsequently grouped and fed in a timed relationship, such as by a flighted conveyor, for subsequent wrapping. Such a conventional wrapping system is disclosed in U.S. Pat. No. 4,430,844.

Figure 7:
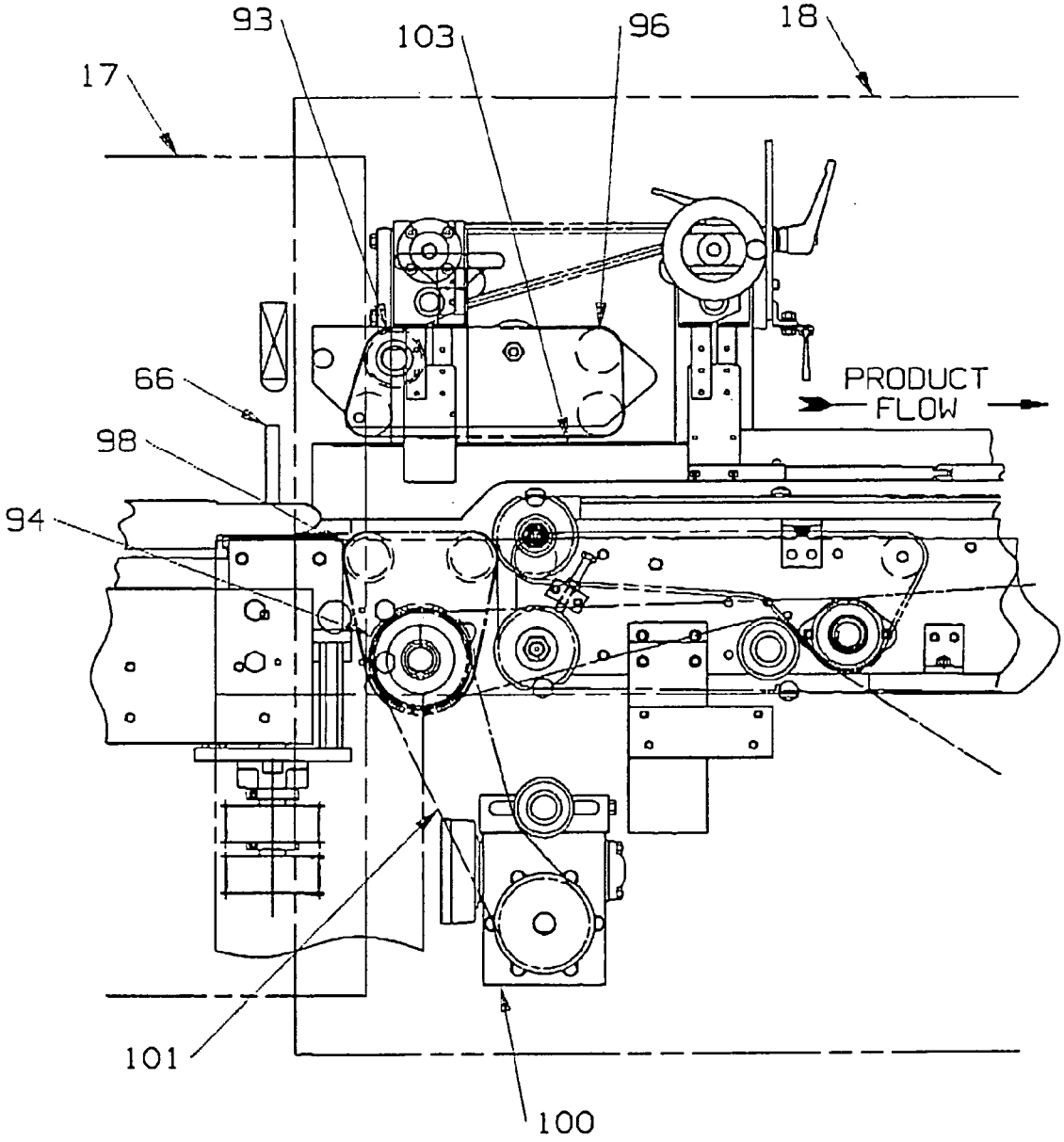
FIG. 7 is an enlarged fragmentary side elevational view of the infeed portion of the wrapper indicated by the circle 7 in FIG. 2.
Figure 8:
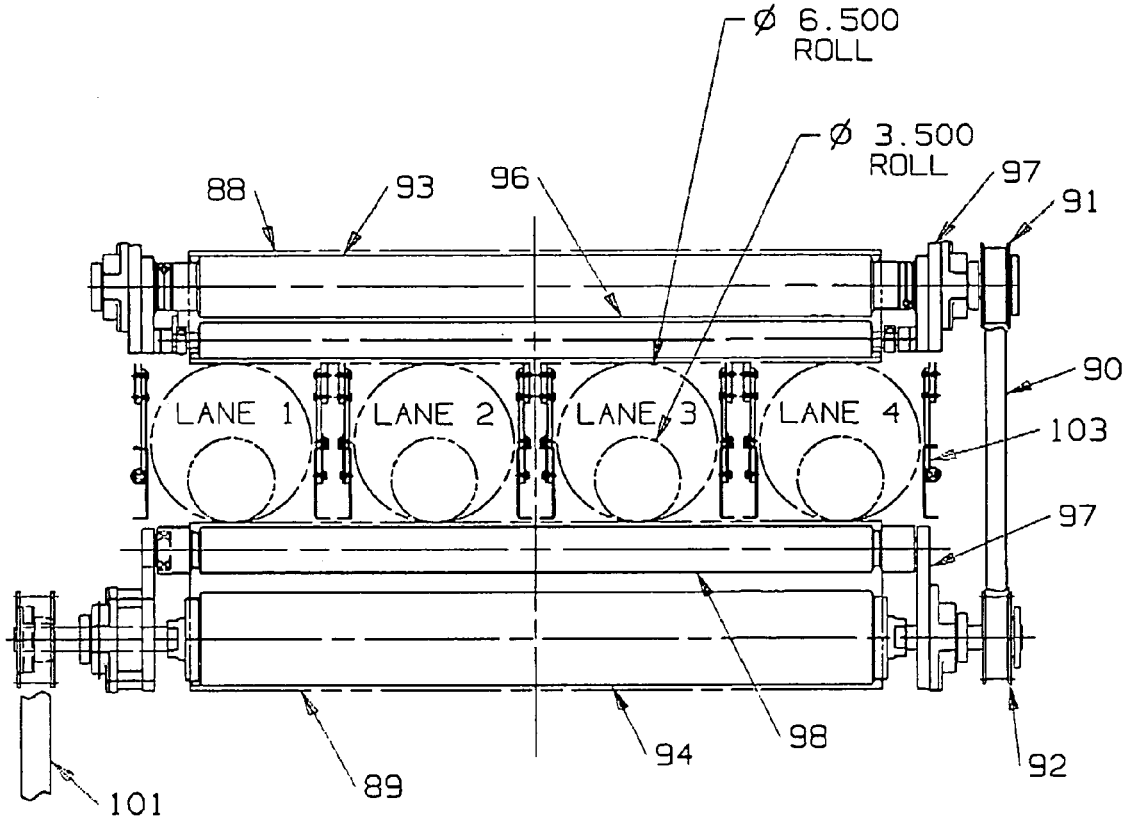
FIG. 8 is a sectional view taken along the line 8—8 of FIG. 2.

FIGS. 7 and 8 show a side elevation and a cross sectional view of a conventional wrapper infeed system. As cut rolls are transported end to end by the second flighted conveyor 17, commonly referred to as a "slug", the leading roll is accelerated as it enters a nip created by upper and lower speed-up belts 88 and 89. The two belts are driven at synchronous speeds through a timing belt 90 driving a pair of pulleys 91 and 92 which are keyed to upper and lower speed-up belt drive rollers 93 and 94. The upper speed-up belt 88 is surface driven by a drive roller 93 and forms an endless loop using a series of idling rollers 96. The rollers are mounted in frictionless bearings that are rigidly mounted to a pair of side frames 97. The lower speed-up belt is surface driven by a drive roller 94 and forms an endless loop using a pair of idling rollers 98. The rollers are mounted in frictionless bearings that are rigidly mounted to the side frames 97.

The surface speed of the upper and lower speed-up belts 88 and 89 is regulated by a servomotor or variable frequency AC motor 100 through a timing belt drive 101. The motor 100 is controlled by the controller 43. Typically, the surface speed of the belts is approximately 10% to 20% faster than the average rate of the second flighted conveyor 17. The over-speed creates a gap between successive rolls, providing room for flight bars in the wrapper to enter behind the rolls to group and synchronize the placement of the product for packaging. An electronic device, such as a photoeye 102, is used to detect the leading edge of the "slug" before entering the speed-up belts. This signal is fed to the machine controller to cause a "correction" if the leading edge of the "slug" is not timed properly with the operation of the flighted conveyor of the wrapper. The "correction" results in an acceleration or deceleration of the pusher flights 66 to advance or retard the placement of the product. A series of lane dividers 103 are used to maintain roll alignment as they are accelerated into the flighted conveyor of the wrapper.

Figure 9:
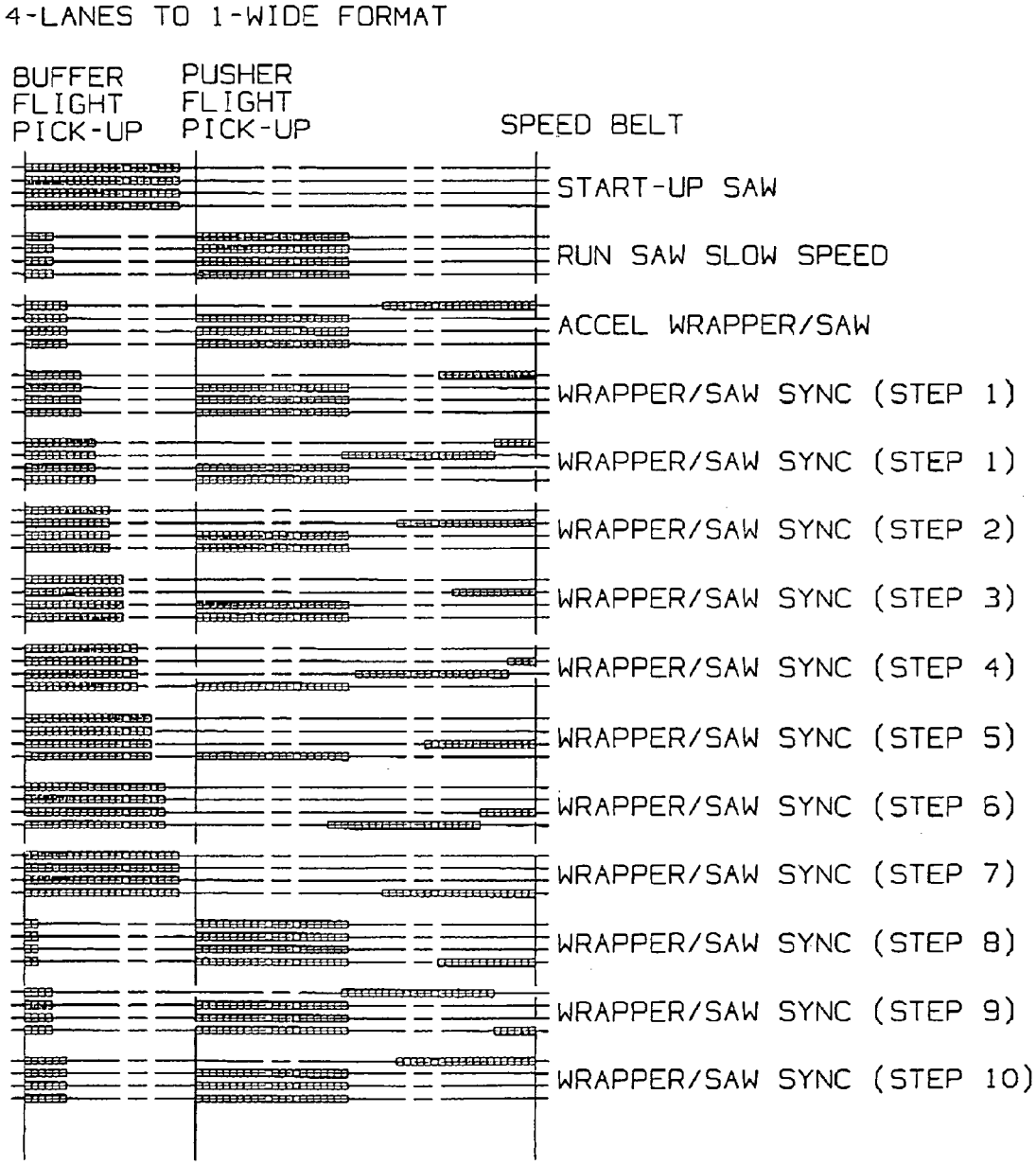
FIG. 9 is a diagrammatic illustration of a typical sequence of operations.

A typical sequence of operation is illustrated in FIG. 9. In this example, a single cut roll is packaged while four lanes of product are cut at the log saw. In a conventional converting operation, a full width web of paper is wound on cardboard mandrels. They are commonly referred to as "logs". The saw cuts the full length "logs" into the desired product length. Typically, the log saw will cut four logs in unison. Logs are commonly 100 to 110 inches in length and are 1 to 2 inches greater in length than that needed to produce an even multiple of cut rolls. When the last roll is cut at the log saw, the excess length creates a piece of waste, called "end trim". The "end trim" is typically culled using a "trim elimination" system. One such system is disclosed in U.S. Pat. No. 6,332,527.

The action of the trim elimination system creates a gap between successive logs during operation. The gap provides room for one of the flights 47, 48 in the first flighted section or buffer 16 to capture the product. The first flighted section accumulates product as it exists the saw, actuates the flights 47, 48 at the appropriate time in the trim eliminate cycle, and transports the logs to the second flighted conveyor 17. The speed of the buffer flights 47, 48 is regulated so that the leading edge of the logs lag behind the position of the pusher flights 66 in the second flighted conveyor. The overall length of the buffer section 16 is equal to the maximum log length plus 10 to 20 inches.

Referring to FIG. 3, the first flighted section 16 overlaps the second flighted section 17 so that the pushers 66 of the second section 17 can engage the trailing ends of the logs before the flight bars 47, 48 disengage from the trailing ends of the logs. The logs are therefor continuously under control of the flight bars and pushers as the logs move from the left end of the product guide trays 21 of the first conveyor section 16 toward the right end of the product guide trays 50 of the second conveyor section 17. The left end portion of the guide trays 21 provide entry portions and the right portions of the guide trays 50 provide exit portions for the logs.

After buffer flights 47, 48 deposit a full set of cut rolls into the second flighted conveyor 17, pusher flights 66 selectively convey one row of cut product at a time into the wrapper infeed 18. This is accomplished by properly controlling the speeds of the two independent flight drives and installing the pusher flights 66 at the proper locations on the flight chain 61. One pusher flight would be mounted on each flight chain for the example shown in FIG. 9. Lanes 2 and 4, driven by one of the drive systems, would have their pushers 66 mounted 180 degrees out of phase with one another. Lanes 1 and 3 driven, by the other drive system, would likewise have their pushers mounted 180 degrees out of phase with one another. The speed of the pusher flights is controlled to match the rate at which packages are produced at the wrapper 18. The overall length of the second flighted section is equal to two times the maximum log length plus 10 to 20 inches.

Figure 10:
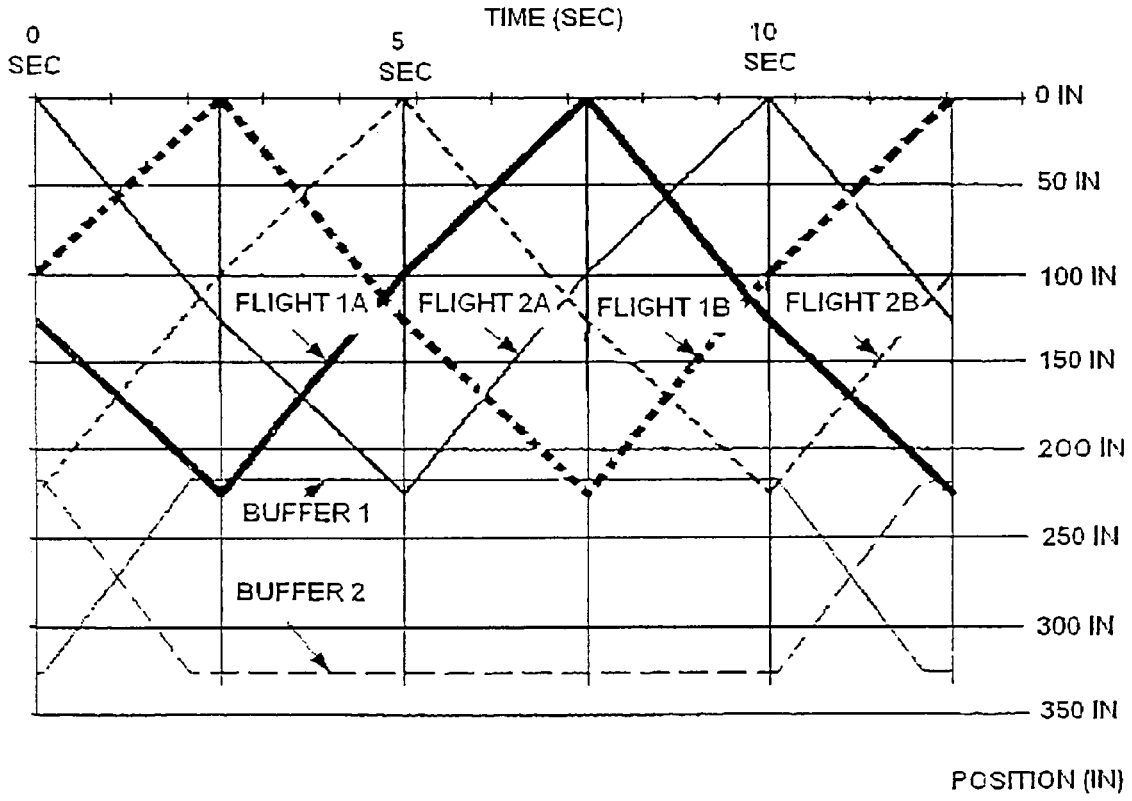
FIG. 10 illustrates the speed and positional relationships of the buffer flights and pusher flights for producing a single roll package from a four-lane log saw.

FIG. 10 illustrates the speed and positional relationships of the buffer flights 47, 48 and pusher flights 66 while producing a single roll package from a four-lane log saw. The vertical axis shows the position of the flights relative to the nip point of the speed-up belts 88 and 89 and has units of inches. The horizontal axis shows the cycle time and has units of seconds. The two buffer flight bars that are mounted equidistant on the flight chains are labeled BUFFER 1 and BUFFER 2. In the example shown the buffer flights are approximately 340 inches from the speed-up belt nip point when they pick up product at the log saw trim eliminator. The buffer flight cycle starts when the flight labeled Buffer 1 is actuated at time equal to approximately 0.1 seconds. This flight transports all four lanes of product from the trim eliminator to the pickup point of the second flighted conveyor 17. The pickup point of the second flighted conveyor is approximately 225 inches from the speed-up belt nip point.

The first buffer flight BUFFER 1 starts to move at a cycle time of approximately 0.1 seconds and completes its move at approximately 1.8 seconds into the cycle. During this time, the second buffer flight, labeled BUFFER 2 and mounted on the same flight chain, is shown returning to the trim eliminator pick up point. Soon after BUFFER 1 deposits four lanes of cut product into the second flighted conveyor 17, the first pusher flight 66, labeled PUSHER 1A, is actuated. This pusher flight moves one lane of cut rolls forward until the leading edge of the log enters the nip point of the speed-up belts 88 and 89. In the example shown, this occurs at a position approximately 99 inches from the speed-up belts. This position coincides with the length of the log less the length of the end trim.

As the first cut roll enters the speed-up belt nip at a cycle time of approximately 4.2 seconds, the speed of the pusher flight is reduced slightly to coincide with the production rate of the wrapper. The pusher flight continues advancing at the proper rate until the last roll enters the speed-up belt nip point at a position equal to 0 inches and cycle time of 6.5 seconds. The opposing pusher flight, labeled PUSHER 1B and driven by the same drive system, is seen returning to the pick up point of the second flighted conveyor 17. The second independently driven pusher flight, labeled PUSHER 2A, is transferring a second lane of cut rolls from the pick up point to the nip point of the speed-up belts 88 and 89. The speed of the second pusher flight is regulated so that the leading edge of the log enters the speed up belt nip immediately after the log in pusher flight PUSHER 1A is exhausted. This occurs at a time equal to approximately 6.5 seconds. This cycle continues until all four lanes are transferred into the wrapper. The buffer flight, labeled BUFFER 2, can be seen transferring a second set of cut rolls from the log saw into the second flighted conveyor 17 at a time equal to approximately 8.8 seconds.

Figure 11:
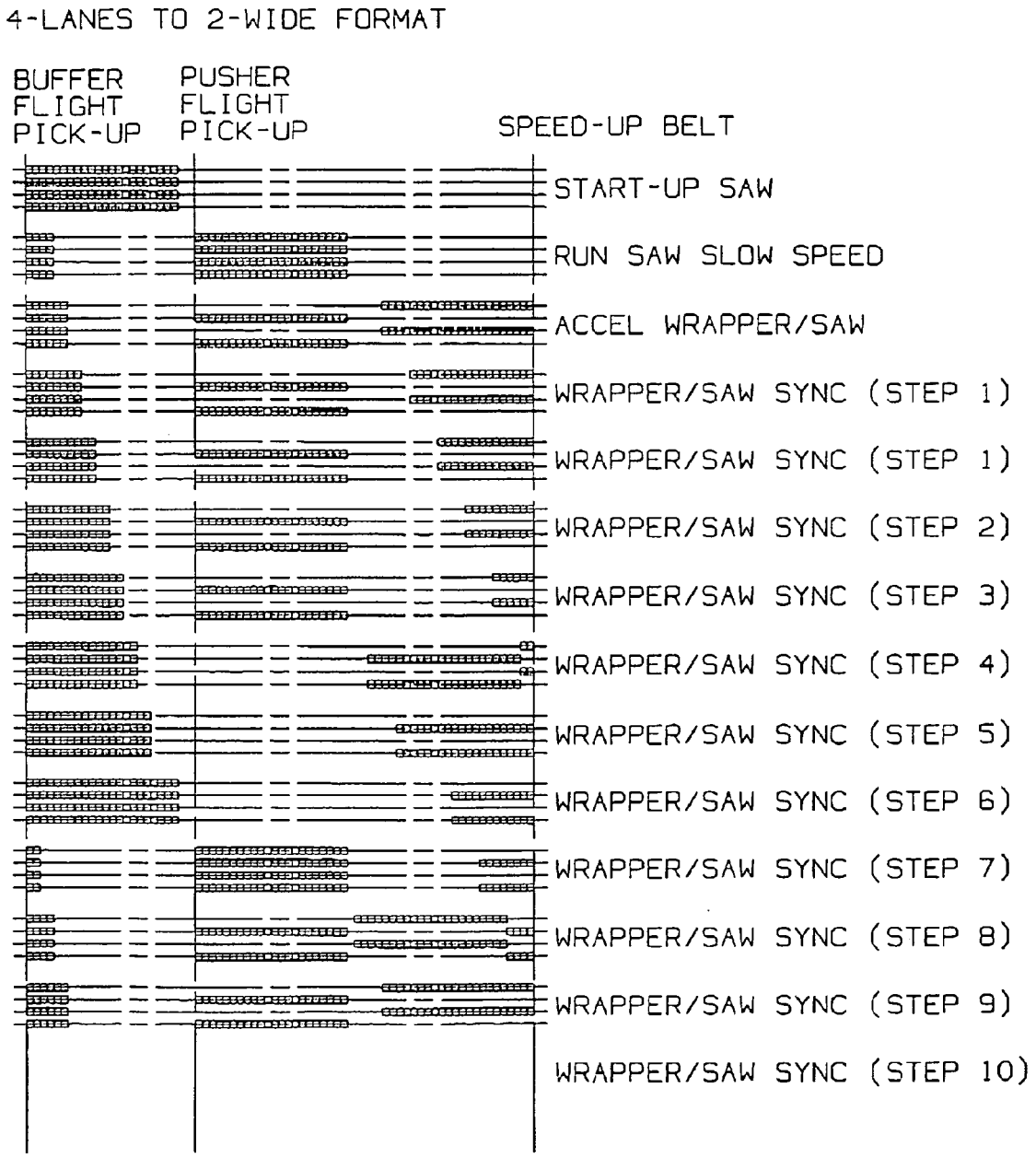
FIGS. 11 and 12 illustrate the sequence of operations for producing, respectively, a two wide and a four wide package format at the wrapper with a four-lane log saw.
Figure 12:
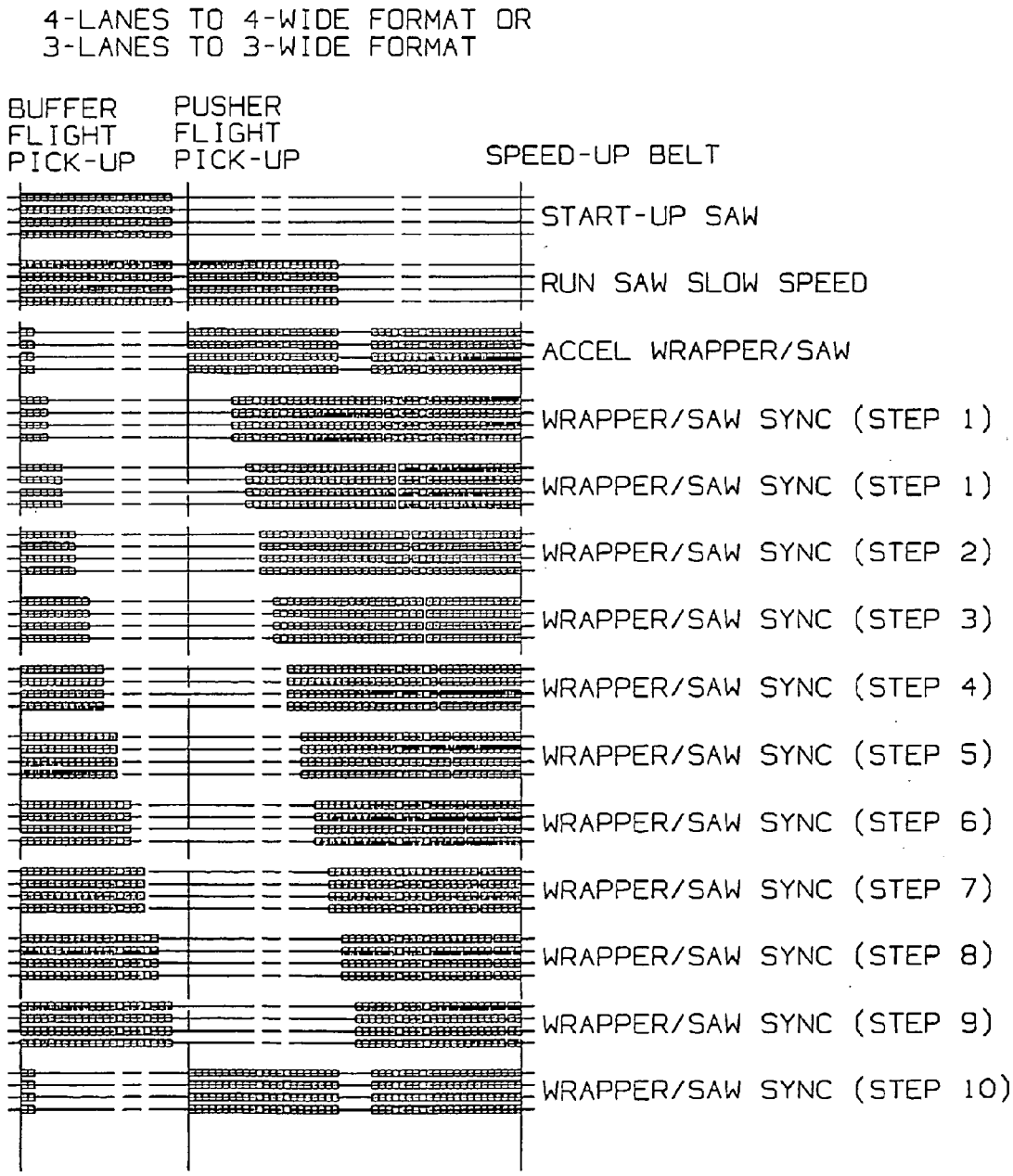

FIGS. 11 and 12 illustrate the sequence of operations used to produce a two wide and a four wide package format at the wrapper with a four-lane log saw. The proper format width is accomplished by placing the pusher flights 66 at the proper locations on the flight chains 61 and regulating the speed of the two independent flight drives. Producing a three wide configuration (not shown) would be similar to a four wide configuration shown in FIG. 11. However, the log saw would be instructed to cut three lanes of product instead of four lanes.

While in the foregoing specification a detailed description of a specific embodiment was set forth for the purpose of illustration, it will be understood that many of the details hereingiven may be varied considerably by those skilled in the art without departing from the spirit and scope of the invention.

We claim:

1. An apparatus for advancing multiple rows of products to a wrapper for wrapping the products comprising:

a frame, a plurality of product supports mounted on the frame for supporting rows of products, the product supports having an entry portion and an exit portion, a conveyor movably mounted on the frame for each product support, a pusher mounted on each conveyor for pushing a row of products along the associated product support from the entry portion toward the exit portion, a first motor for driving at least one of the conveyors, and a second motor for driving at least another of the conveyors, whereby said one conveyor and said another conveyor and the pushers mounted thereon can be driven independently of each other.

2. The apparatus of claim 1 in which each of said conveyors comprises an endless chain and sprockets supporting the chain.

3. The apparatus of claim 2 in which each of said motors is drivingly connected to at least one of said sprockets.

4. The apparatus of claim 1 including at least four of said product supports and four of said conveyors, each of said motors driving at least two of the conveyors.

5. The apparatus of claim 4 in which each of said conveyors comprises an endless chain and sprockets supporting the chain.

6. The apparatus of claim 5 including a first drive belt for rotating the sprockets of at least two of the conveyors and a second drive belt for rotating the sprockets of at least another two of the conveyors, the first motor driving the first drive belt and the second motor driving the second drive belt.

7. The apparatus of claim 1 in which each of the products supports comprises a trough-shaped guide tray.

8. An apparatus for advancing multiple rows of products to a wrapper for wrapping the products comprising:

a frame a plurality of product supports mounted on the frame for supporting rows of products, the product supports having an entry portion and an exit portion, each of the product supports comprising a trough-shaped guide tray, a conveyor movably mounted on the frame for each product support, a pusher mounted on each conveyor for pushing a row of products along the associated product support toward the exit portion, each of the trough-shaped guide trays being provided with a slot through which one of said pushers extends, a first motor for driving at least one of the conveyors, and a second motor for driving at least another of the conveyors, whereby said one conveyor and said another conveyor and the pushers mounted thereon can be driven independently of each other.

9. The apparatus of claim 1 in which a pair of pushers is mounted on each conveyor for pushing a row of products along the associated product support toward the exit portion.

10. An apparatus for advancing multiple rows of products to a wrapper for wrapping the products comprising:

a frame, a plurality of product supports mounted on the frame for supporting rows of products, the product supports having an entry portion and an exit portion, each of the product supports comprising a trough-shaped guide tray, a conveyor movably mounted on the frame for each product support, a pusher mounted on each conveyor for pushing a row of products along the associated product support toward the exit portion, a first motor for driving at least one of the conveyors, and a second motor for driving at least another of the conveyors, whereby said one conveyor and said another conveyor and the pushers mounted thereon can be driven independently of each other, a buffer conveyor movably mounted on said frame and a bar mounted on the buffer conveyor for pushing products on the product supports from the entry portions thereof toward said pushers.

11. The apparatus of claim 10 in which said buffer conveyor includes a pair of endless chains and sprockets supporting each of said endless chains, said bar being supported by each of said endless chains and extending across the product supports.

12. The apparatus of claim 11 in which one of said sprockets for each of said endless chains is a driven sprocket, and a third motor drivingly connected to each of said driven sprockets.

13. The apparatus of claim 11 including a second bar supported by each of said endless chains and extending across the product supports for pushing products on the product supports from the entry portions thereof said toward said pushers.

14. An apparatus for advancing multiple rows of products to a wrapper for wrapping the products comprising:

a frame, a plurality of product supports mounted on the frame for supporting rows of products, the product supports having an entry portion and an exit portion, a conveyor movably mounted on the frame for each product support, a pusher mounted on each conveyor for pushing a row of products along the associated product support toward the exit portion, a first motor for driving at least one of the conveyors, and a second motor for driving at least another of the conveyors, whereby said one conveyor and said another conveyor and the pushers mounted thereon can be driven independently of each other, upper and lower speed-up belts adjacent the exit portions of the product supports, and a third motor drivingly connected to the speed-up belts.

15. An apparatus for advancing multiple rows of products to a wrapper for wrapping the products comprising:

a frame, a plurality of product supports mounted on the frame for supporting rows of products, the product supports having an entry portion and an exit portion, a conveyor movably mounted on the frame for each product support, a pusher mounted on each conveyor for pushing a row of products along the associated product support toward the exit portion, a first motor for driving at least one of the conveyors, and a second motor for driving at least another of the conveyors, whereby said one conveyor and said another conveyor and the pushers mounted thereon can be driven independently of each other, upper and lower speed-up belts adjacent the exit portions of the product supports, an upper driven roller and an upper idler roller rotatably mounted on the frame and supporting the upper speed-up belt, a lower driven roller and a lower idler roller rotatably mounted on the frame and supporting the lower speed-up belt, and a third motor drivingly connected to the upper and lower driven rollers.

* * * * *